US007383598B2

(12) United States Patent
Titcomb

(10) Patent No.: US 7,383,598 B2
(45) Date of Patent: Jun. 10, 2008

(54) BED COVERS

(75) Inventor: Mark Titcomb, Reading (GB)

(73) Assignee: Cuddle Buddies Limited, Berkshire (GB)

( * ) Notice: Subject to any disclaimer, the term of this patent is extended or adjusted under 35 U.S.C. 154(b) by 35 days.

(21) Appl. No.: 10/583,074

(22) PCT Filed: Dec. 6, 2004

(86) PCT No.: PCT/GB2004/005120

§ 371 (c)(1),
(2), (4) Date: Jun. 15, 2006

(87) PCT Pub. No.: WO2005/058105

PCT Pub. Date: Jun. 30, 2005

(65) Prior Publication Data

US 2007/0151030 A1 Jul. 5, 2007

(30) Foreign Application Priority Data

Dec. 16, 2003 (GB) ..... 0329110.1

(51) Int. Cl.
*A47G 9/02* (2006.01)

(52) U.S. Cl. ..... 5/502; 5/907; 5/482; 5/486; D6/598; D6/599

(58) Field of Classification Search ..... 5/482, 5/486, 502, 907, 500; D6/598, 599; 446/72
See application file for complete search history.

(56) References Cited

U.S. PATENT DOCUMENTS

| | | | | |
|---|---|---|---|---|
| 4,236,263 | A * | 12/1980 | Allee | 5/413 R |
| 4,590,633 | A * | 5/1986 | Pickens | 5/482 |
| 4,734,948 | A | 4/1988 | Danova | |
| 5,084,930 | A * | 2/1992 | Danova | 5/502 |
| 5,208,934 | A | 5/1993 | Bachnick et al. | |
| 5,421,045 | A | 6/1995 | Bowen | |
| 5,515,559 | A * | 5/1996 | Benson | 5/413 R |
| 5,638,561 | A | 6/1997 | Sperry et al. | |
| 6,427,267 | B1 * | 8/2002 | Turner | 5/482 |
| 6,551,166 | B1 | 4/2003 | Myers | |

FOREIGN PATENT DOCUMENTS

| | | |
|---|---|---|
| DE | 39 26 364 | 7/1990 |
| DE | DE3926364 | 7/1990 |
| EP | 0 269 431 | 6/1988 |
| EP | 0 269 431 A2 | 6/1988 |
| GB | 922 723 A | 4/1963 |
| GB | 2 415 131 B | 2/2007 |

* cited by examiner

*Primary Examiner*—Michael Trettel
(74) *Attorney, Agent, or Firm*—Martin Fleit; Paul D. Bianco; Fleit Gibbons Gutman Bongini & Bianco P.L.

(57) ABSTRACT

A bed cover (12) comprising an envelope (13) made of a textile fabric for receiving a filling material. The envelope (13) has a generally rectangular shaped portion (14) for covering a bed, and a projection (15) that extends beyond one edge of the rectangular portion (14) defining a pocket for receiving a filling material to form a comforter (17) for the occupant of the bed to cuddle. The filling material is preferably a complementary shaped duvet or quilt comprising a main portion of generally rectangular shape and a second portion that defines the comforter (17), that is fitted inside the envelope (13).

17 Claims, 2 Drawing Sheets

BED COVERS

The present invention relates to bed covers.

The term "bed covers" as used herein is taken to include duvets, duvet covers, quilts, and quilt covers, that in use cover an occupant in a bed.

There is a need, particularly with small children, for a comforter that the child may cuddle whilst falling to sleep.

There have been many proposals where a toy has been attached to a quilt or duvet. See for example U.S. Pat. Nos. 5,084,930, 5,208,934 and DE 3,926,364. These designs of quilt or duvet are expensive because of the need to buy and attach separate toys to a separate quilt.

Furthermore these designs of quilt do not allow for a complete image to be printed on the body of the quilt and the comforter using graphics that blends or matches the design of comforter with the rest of the quilt.

An object of the present invention is to provide a bed cover in the form of an envelope that has a profile that includes an integral projection shaped to receive a filling material that defines an integral comforter that, in use, the occupant of the bed can cuddle.

A further object of the present invention is to provide a bed cover that incorporates a comforter on to which an image can be printed that merges the body of the quilt with the design of the comforter.

According to the present invention there is provided a bed cover as set out in the attached claims.

The invention will now be described by way of example with reference to the accompanying drawings in which.

Figure 1:
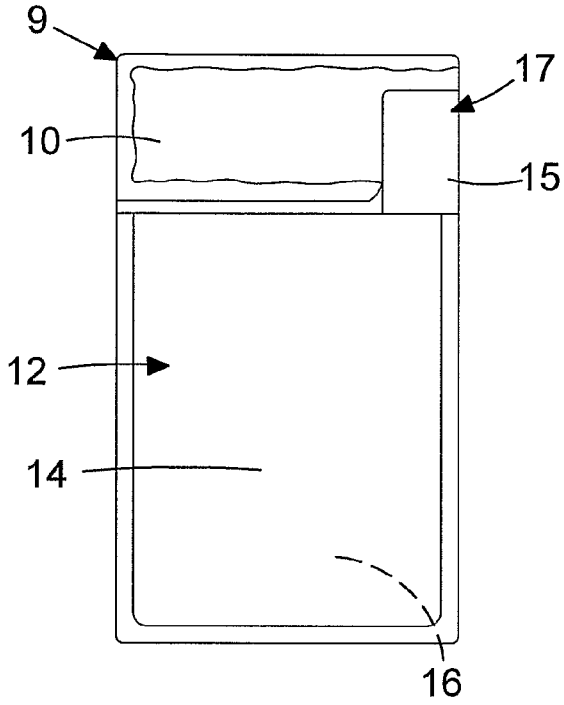
FIGS. 1 and 2 illustrate schematically bed covers having a comforter constructed in accordance with the present invention.

Referring to FIG. 1 there is shown a plan view of a bed 9 of normal construction comprising a base (not shown) on to which is laid a mattress (not shown), under-blankets or sheets (not shown), pillows 10, and a bed cover 12 constructed in accordance with the present invention.

The bed cover 12 comprises an outer envelope 13 made of a textile fabric, such as woven cotton or man-made fibres, that has a profile, when viewed in plan from above the bed, that has a main portion 14 of generally of rectangular shape and a second portion 15 that projects beyond an edge of the rectangular portion 14 towards the top of the bed.

The envelope contains an infill 16 of feathers or textile filaments or fibres. It is preferred that the infill 16 is in the form of a duvet or quilt 16 that is of a complementary shape to that of the envelope 13 so as to cover the bed 9 and the occupants when lying in the bed, and form an integral comforter 17. Alternatively the comforter 17 may be detachable from the main part of the duvet 16 as explained below.

The comforter 17 extends predominantly in a direction which in use extends along the length of the duvet 13. In other words, the comforter 17 extends predominantly towards the head of the bed and is located at one of the top corners of the rectangular part of the duvet 16.

In an alternative design of bed cover 12 the comforter 17 may be detachable from the rectangular part of the duvet 16. In this case, the comforter 17 and the rectangular part 14 of the duvet 16 are provided with a fastening means 18 which may be in the form of a hook and loop fastener of the type sold under the registered Trade Mark Velcro, or may be a conventional zip fastener, or a series of press studs comprising components fitted to each of the comforter 17 and the main part of the duvet 16. The envelope 13 of a corresponding shape to the rectangular portion 14 of the duvet 16 with the comforter 17 attached is slid over the comforter 17 and duvet 16.

The comforter 17 may be a simple cylindrical shape or of circular, oval, rectangular, elliptical, hexagonal, or octagonal cross sectional shape.

The predominant dimension of the comforter 17 preferably extends beyond the top edge of the envelope by a distance of 20 cm to 40 cms, and the dimension that extends laterally to the predominant direction is in the range of 15 cm to 30 cms. Preferably the predominant dimension is 40 cms and the transverse dimension is 20 cms.

Figure 2:
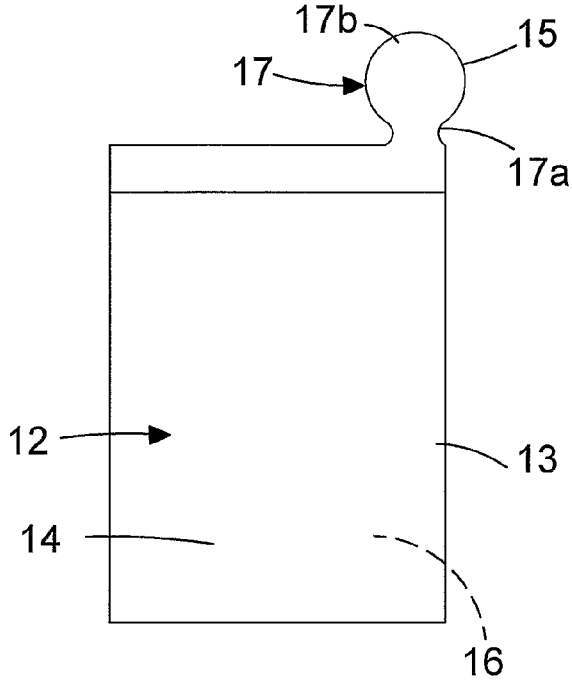

As shown in FIG. 2 the comforter 17 may be shaped in the form of a circular shape corresponding to an approximate shape of a head of a person and may have a slightly reduced neck portion 17(*a*) connecting the circular portion 17(*b*) to the duvet 16. In the latter instance, the envelope 13 could be printed with the picture or image of the face of a cartoon character or a person, such as a famous celebrity, at a region corresponding to the "face" of the comforter 17. The face may be printed on both sides of the comforter, thereby enabling the bed cover to be used with the comforter 17 on the left or right hand side of the bed.

Figure 3:
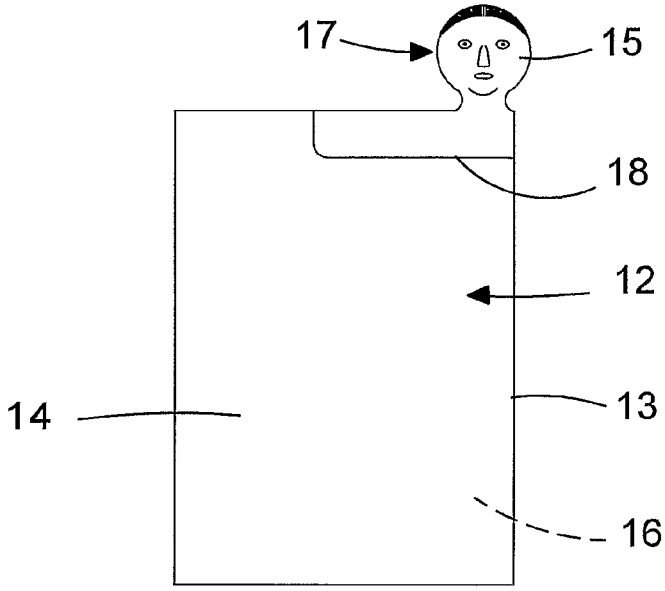
FIGS. 3 to 5 show alternative designs of comforter constructed in accordance with the present invention for attachment to conventional duvets to make a bed cover according to the present invention.
Figure 4:
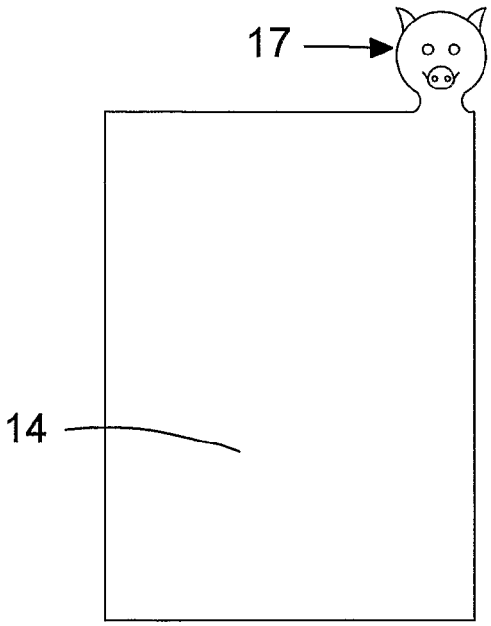
Figure 5:
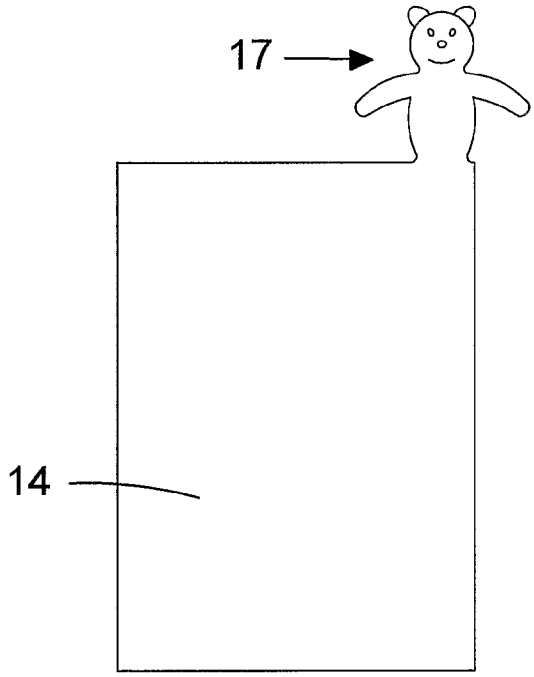

Referring to FIGS. 3 and 4 the comforter 17 may be in the form of a cartoon character, or cuddly toy such as a teddy bear, badger, elephant, or similar character, in which case the duvet 16 and comforter 17 is suitably shaped with a complimentary shape to fit the character incorporated into the envelope 13. In all instances, the comforter 17 extends predominantly in a direction along the length of the bed. That is to say that it has a major dimension which extends in the same direction as the along the longitudinal length of the bed cover and the bed.

Although the duvet 16 and comforter 17 may be an integral unitary construction with the infill filling both the rectangular part 14 of the duvet 16 and the comforter 17, the comforter 17 may be separately filled, it may be possible to construct the envelope 13 with a separate pocket similar to that of a pillow case. In this case the pocket would be shaped so that it has a predominant dimension extending along the length of the bed towards the head of the bed, and the pocket filled either with loose infill material (feathers or fibres) or a pillow-like cushion.

In the case where the comforter 17 is detachable from the duvet (16), the comforter 17 may be removed when the child outgrows the need for the comforter and the duvet 16 may continue in use as a straight forward conventional rectangular shaped duvet and duvet cover.

Although not shown in the drawings it is to be understood that the envelope 13 may be printed on at least one side, if not on both sides, with a picture or image of a scene where the comforter 17 forms an integral part of the whole picture or image. In this way the complete picture or image can be printed on the envelope using relative cheap textile printing techniques without the need for making separate toys.

Furthermore one envelope 13 can be exchanged for another that has a totally different design or picture whilst still using the same inner quilt or duvet 16.

The invention claimed is:

1. A bed cover for positioning over an occupant in a bed, the cover comprising an envelope made of a textile fabric which has a hollow interior for receiving a filling material, said hollow interior being of generally rectangular shape with an integral pocket that extends beyond the top edge of the rectangular shape to define a comforter for the occupant to cuddle, and which, in use, lies above the occupant of the bed.

2. A bed cover according to claim 1 wherein the comforter portion is shaped to form an approximate shape of a person's head.

3. A bed cover according to claim 1 wherein the comforter portion is shaped to form a part of a cuddly toy.

4. A bed cover according to claim 1 wherein the comforter portion is shaped to form a part of a cartoon character.

5. A bed cover according to claim 1 wherein the comforter portion is shaped to form a body and head of a cartoon character.

6. A bed cover according to claim 1 wherein the comforter portion is shaped to form a cylindrical shape.

7. A bed cover according to claim 1 wherein the comforter portion is located at a corner of the rectangular shape.

8. A bed cover according to claim 2 wherein the envelope is decorated with a face of a person or cartoon character at a region corresponding to an intended position of a face on the comforter.

9. A bed cover according to claim 1 wherein the comforter portion and the comforter has a predominant dimension of the order of 20 cms to 40 cms and a dimension transverse to the predominant dimension of the order of 15 cms to 30 cms.

10. A bed cover according to claim 1 wherein the filling material is a complementary shaped duvet or quilt fitted inside the envelope and comprises a main portion of generally rectangular profile and a second portion that defines a comforter.

11. A bed cover for positioning over an occupant in a bed comprising:

an envelope made of a textile fabric which, in use, contains a filling material, wherein the envelope has a profile that is of generally rectangular shape; and an integral comforter portion that extends beyond the top edge of the rectangular shape to define a comforter for the occupant to cuddle, and which, in use, lies above the occupant of the bed, wherein the comforter portion is shaped to form an approximate shape of a person's head; and wherein the envelope is decorated with a face of a person or cartoon character at a region corresponding to an intended position of a face on the comforter, and the face of the person or cartoon character is printed on each side of the comforter so as to enable the comforter to be used on a left or right hand side of the bed.

12. A bed cover for positioning over an occupant in a bed comprising:

an envelope made of a textile fabric which, in use, contains a filling material, wherein the envelope has a profile that is of generally rectangular shape; and an integral comforter portion that extends beyond the to edge of the rectangular shape to define a comforter for the occupant to cuddle, and which, in use lies above the occupant of the bed, wherein the filling material is a complementary shaped duvet or quilt fitted inside the envelope and comprises a main portion of generally rectangular profile and a second portion that defines a comforter; and wherein the second portion of the filling material is integral with the main portion.

13. A bed cover according to claim 10 wherein the second portion of the filling material is separate from the main portion.

14. A bed cover for positioning over an occupant in a bed comprising:

an envelope made of a textile fabric which, in use, contains a filling material, wherein the envelope has a profile that is of generally rectangular shape; and an integral comforter portion that extends beyond the top edge of the rectangular shape to define a comforter for the occupant to, cuddle and which, in use, lies above the occupant of the bed, wherein the filling material is a complementary shaped duvet or quilt fitted inside the envelope and comprises a main portion of generally rectangular profile and a second portion that defines a comforter; and wherein the second portion is detachably connected to the main portion of the filling material by means of a releasable fastening means.

15. A bed cover according to claim 14 wherein the fastening means is a loop and hook fastener wherein one part of the fastener is attached to the comforter and a second part of the fastener is attached to the generally rectangular portion of the bed cover.

16. A bed cover according to claim 15 wherein the fastening means comprises a plurality of spaced press studs wherein one part of each press stud is attached to the comforter and a second part of the press stud is attached to the generally rectangular portion of the bed cover.

17. A bed cover according to claim 14 wherein the fastening means comprises a zip fastener wherein one pert of the zip fastener is attached to the comforter and a second part of the zip fastener is attached to the generally rectangular portion of the bed cover.

* * * * *